US006550438B2

(12) United States Patent
Rabis

(10) Patent No.: US 6,550,438 B2
(45) Date of Patent: Apr. 22, 2003

(54) VALVE DRIVE HAVING A ROCKER ARM

(75) Inventor: Manfred Rabis, Schorndorf (DE)

(73) Assignee: Andreas Stihl AG & Co. (DE)

( * ) Notice: Subject to any disclaimer, the term of this patent is extended or adjusted under 35 U.S.C. 154(b) by 0 days.

(21) Appl. No.: 09/944,763

(22) Filed: Aug. 31, 2001

(65) Prior Publication Data

US 2002/0026917 A1 Mar. 7, 2002

(30) Foreign Application Priority Data

Sep. 2, 2000 (DE) ..... 100 43 230

(51) Int. Cl.[7] ..... F01L 1/18

(52) U.S. Cl. ..... 123/90.41; 123/90.39; 123/90.42

(58) Field of Search ..... 123/90.41, 90.39, 123/90.42

(56) References Cited

U.S. PATENT DOCUMENTS 5,832,889 A * 11/1998 Naruoka et al. ..... 123/90.18

FOREIGN PATENT DOCUMENTS

DE 19845489 A1 8/2001

* cited by examiner

*Primary Examiner*—Thomas Denion
*Assistant Examiner*—Jaime Corrigan
(74) *Attorney, Agent, or Firm*—R W Becker & Associates; R W Becker

(57) ABSTRACT

A valve drive mechanism is provided that has a rocker arm that by means of a swivel joint is movable about a pivot axis that extends transverse to the rocker arm. A control unit serves to actuate one end of the rocker arm, the other end of which actuates a poppet valve. A guide element, which is disposed between the end of the valve stem of the poppet valve and the other end of the rocker arm, serves to secure the position of the other end of the rocker arm relative to the valve stem end. The guide element is separate from the rocker arm and valve stem, and the other end of the rocker arm comes to rest between abutment surfaces of the guide element.

12 Claims, 3 Drawing Sheets

VALVE DRIVE HAVING A ROCKER ARM

BACKGROUND OF THE INVENTION

The present invention relates to a valve drive mechanism that has a rocker arm.

A valve drive, especially for an internal combustion engine of a manually guided implement, has a rocker arm that by means of a swivel joint is movable about a pivot axis that extends transverse to the rocker arm, and that is held on the cylinder head of the internal combustion engine. A control unit that acts upon one end of the rocker arm electromechanically, mechanically or in some other suitable manner, serves for the actuation of the poppet valve. For this purpose, the other end of the rocker arm acts upon the end of the valve stem of the poppet valve.

DE 198 45 489 A1 discloses a valve drive having a rocker arm, according to which flat portions are bent out of the side wall of the rocker arm for the lateral guidance of the rocker arm on the valve stem end of the poppet valve. These portions are cut out of the rocker arm and are bent about 180° and project from the rocker arm in the direction of the valve. Such a construction weakens the rocker arm in the region of that end that actuates the valve stem, as a consequence of which the rocker arm is susceptible to fatigue failure. A further drawback of this known valve drive is that the geometry of the rocker arm thereof must be coordinated to the end of the valve stem.

It is an object of the present invention to provide a valve drive mechanism that while providing a rigid, straightforward rocker arm configuration, ensures a reliable lateral guidance between the rocker arm and the end of the valve stem of the poppet valve.

BRIEF DESCRIPTIONS OF THE DRAWINGS

This object, and other objects and advantages of the present invention, will appear more clearly from the following specification in conjunction with the accompanying schematic drawings, in which.

SUMMARY OF THE INVENTION

Figure 1:
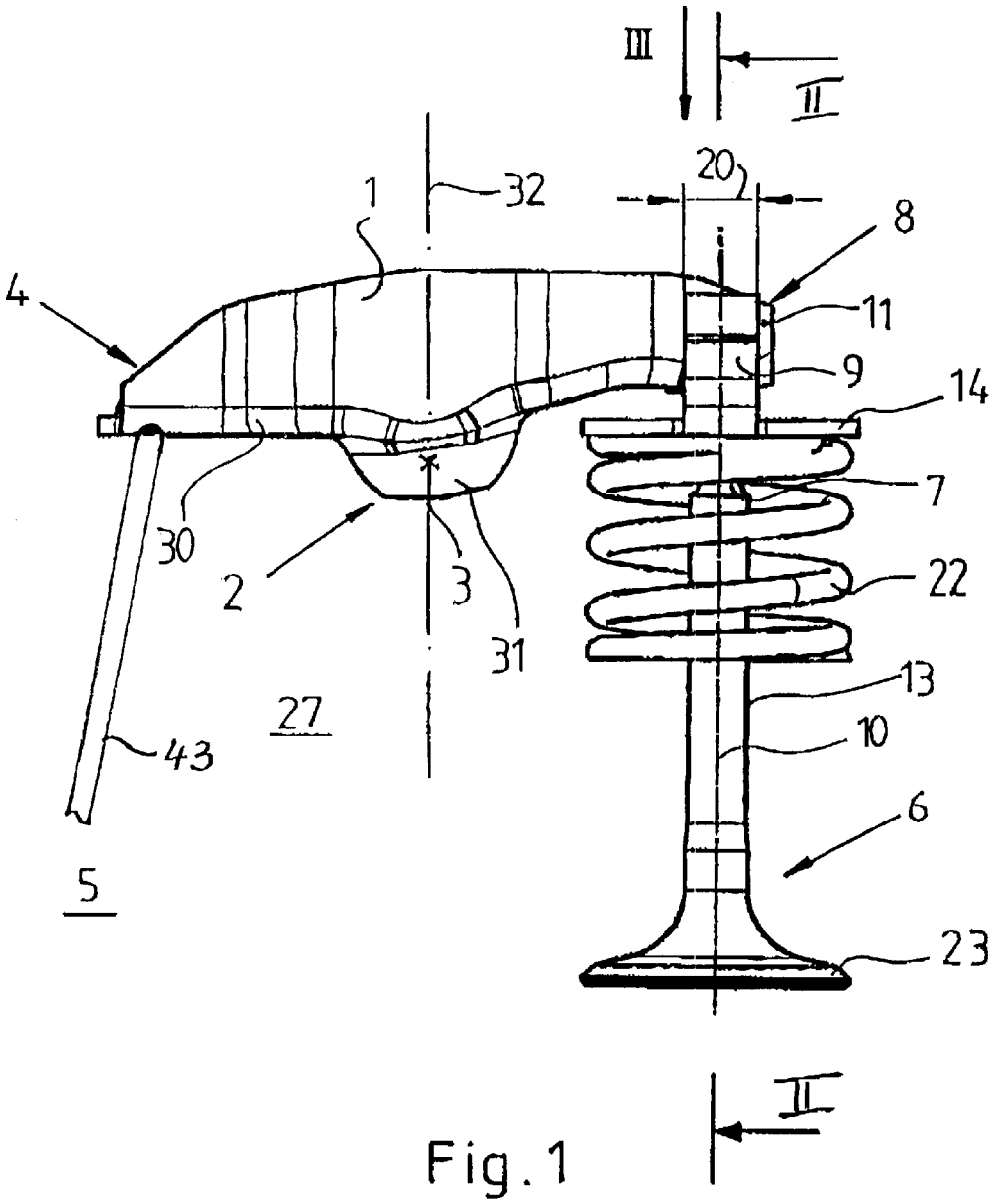
FIG. 1 is a side view of a rocker arm of one exemplary embodiment of an inventive valve drive mechanism.

The valve drive mechanism of the present invention comprises a rocker arm that by means of a swivel joint is movable about a pivot axis that extends transverse to the rocker arm; a poppet valve having a valve stem, with a second end of the rocker arm acting upon an end of the valve stem; a control unit that engages a first end of the rocker arm for actuating the poppet valve; and a guide element that is disposed between the valve stem end and the second end of the rocker arm, wherein the guide element is separate from the rocker arm and is a part of a valve spring retainer that is disposed on the valve stem, wherein the guide element is provided with oppositely disposed abutment surfaces that extend transverse to a longitudinal axis of the poppet valve, and wherein the second end of the rocker arm is disposed between the abutment surfaces of the guide element in such a way that the position of the second end is secured relative to the valve stem end.

Thus, pursuant to the present invention for the lateral guidance of that end of the rocker arm that rests upon the end of the valve stem of the poppet valve, a guide element, or a guide mechanism comprising guide elements, is provided, whereby the guide element is provided as part of a valve spring retainer of the poppet valve, and the guide element is provided with oppositely disposed abutment surfaces to secure the position of that end of the rocker arm relative to the end of the valve stem. The abutment surfaces are preferably planar. However, it can also be expedient, for example to form a linear abutment against the rocker arm, to make the abutment surfaces spherically bulged.

As indicated above, the guide element is separate from the rocker arm and is preferably monolithically formed with the valve spring retainer.

The guide element is advantageously a component having a U-shaped cross-sectional configuration, with the legs of the component forming a lateral guidance against the rocker arm by means of abutment surfaces. The legs of the guide element are bent out of the valve spring retainer as tabs, whereby the spacing between the legs can correspond approximately to the width of the rocker arm at the location where the legs come to rest against the rocker arm. The legs of the guide element are preferably bent up from oppositely disposed strips of material of the valve spring retainer. The width of the legs is expediently approximately the same as the diameter of the valve stem end, and is dimensioned such that no tilting of that end of the rocker arm that moves between the legs of the guide element is possible.

The rocker arm itself is preferably a sheet metal part that is formed by being shaped, and that has an approximately U-shaped cross-sectional configuration. In this connection, the open side faces away from the poppet valve. It may be expedient to form the swivel joint on the rocker arm, for which purpose a spherical segment is formed in the base of the rocker arm; extending into the spherical segment is a partially spherical bearing portion of a support pin that is fixed in the cylinder head. To allow the end of the valve stem to extend through, the guide element has a slot, or at least a partially circular opening having a span of more than 180°, as a result of which the guide element is positively secured on the end of the valve stem in the plane of the rocker arm. It can be expedient to hold the guide element in such a way that it is not displaceable in the axial direction of the longitudinal axis of the valve, preferably by holding the guide element in a groove or notch of the end of the valve stem.

Further specific features of the present invention will be described in detail subsequently.

DESCRIPTION OF PREFERRED EMBODIMENTS

Figure 4:
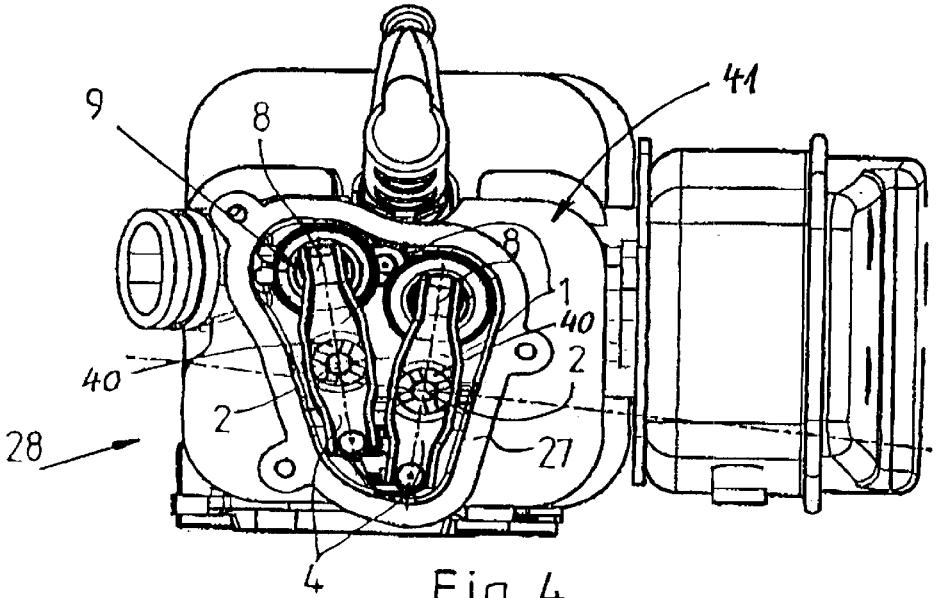
FIG. 4 is a top view of a valve drive in an internal combustion engine, with the valve housing cover removed.
Figure 5:
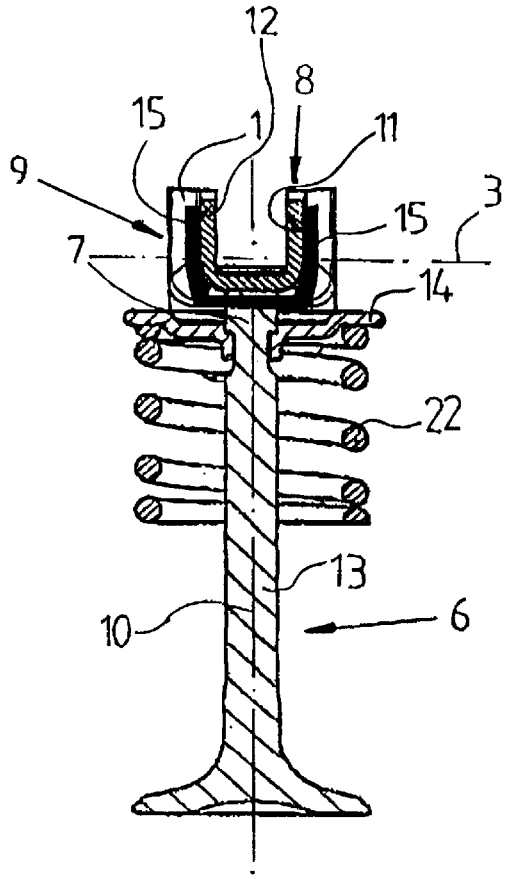
FIG. 5 is a cross-sectional view similar to that of FIG. 2 through a further exemplary embodiment of the inventive lateral guidance of a rocker arm.

Referring now to the drawings in detail, FIG. 1 shows a side view of a rocker arm 1 of a valve drive of an internal combustion engine 28 (illustrated in FIG. 4) for a manually guided implement. The base 30 of the rocker arm I is provided with a spherical segment 31 for a swivel joint 2.

The bearing portion of a support pin 40 extends into the spherical segment 31; the support pin 40 is held in the cylinder head 41, preferably by being threaded therein. In this manner, the rocker arm 1 is fixed on the housing 27 of the internal combustion engine in such a way as to be pivotable about a pivot axis 3 that is disposed transverse to the rocker arm 1. A control unit 5, which is not shown in detail, acts mechanically, electromechanically, or in any other suitable manner, for example via a push rod 43, upon one end 4 of the rocker arm 1. The rocker arm 1, by means of its other end 8, which is disposed opposite the end 4, acts upon a valve stem end 7 of a gas-change or poppet valve 6 in order to actuate this valve. The valve member of the poppet valve is formed in a known manner essentially of a valve disk or head 23 and a valve shaft or stem 13 that adjoins the valve head.

Figure 6:
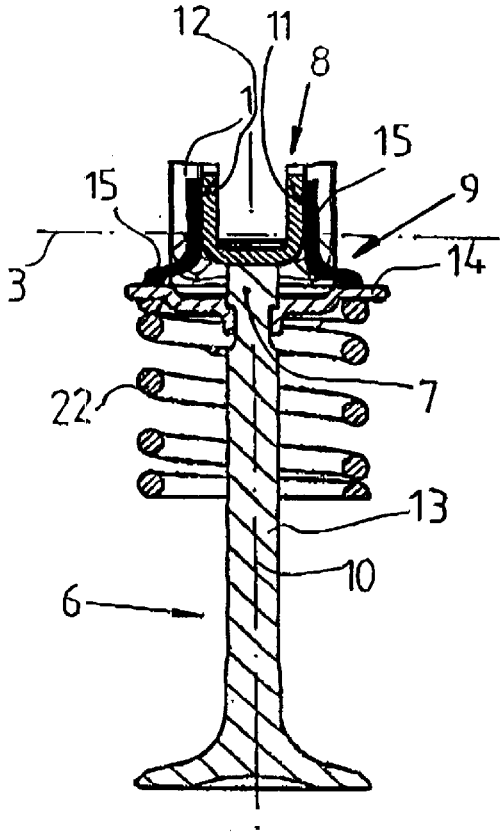
FIG. 6 is a cross-sectional view similar to that of FIG. 2 through a third exemplary embodiment of an inventive valve drive mechanism.

Disposed between the end 8 of the rocker arm 1 and the valve stem end 7 is a guide element 9 for guiding especially for laterally guiding, the rocker arm 1 transverse to the longitudinal axis 10 of the valve. For this purpose, the guide element 9 is provided with oppositely disposed contact or abutment surfaces 11,12 for securing the position of the end 8 of the rocker arm 1 relative to the valve shaft stem 7 (see FIG. 2). To provide a variably usable lateral guidance relative to the geometry of the valve drive, the guide element 9 is separate from the rocker arm 1 and preferably is also separate from the valve stem 13 (see FIGS. 1 and 6). The guide element 9 is held on the valve stem 13 and the end 8 of the rocker arm 1 comes to rest between the oppositely disposed abutment surfaces 11,12 of the guide element (see FIG. 2). As can furthermore be seen from the sectional view of FIG. 2, pursuant to a first exemplary embodiment the guide element 9 can be a portion of a valve spring retainer 14 of the poppet valve 6. Relative to the longitudinal axis 10 of the valve, the valve spring retainer 14 is held on the valve stem end 7 between this end and a valve spring 22 that coaxially surrounds the valve stem 13. In the embodiment illustrated in FIGS. 2 to 4, the guide element 9 is monolithically formed with the valve spring retainer 14. However, it can also be expedient to frictionally, interlockingly, or otherwise positively fix the guide element 9 in position on the valve spring retainer 14, as illustrated in FIG. 6.

The guide element 9 is preferably a component having a U-shaped cross-sectional configuration, the legs 15 of which form a lateral guidance for the rocker arm 1. The legs 15 can be formed, preferably monolithically, on the rim of the valve spring retainer 14 as strips of material, and are appropriately bent. It can be expedient to bend the legs 15 up and back in an S-shaped manner from oppositely disposed regions of the rim 16 of the valve spring retainer 14. The legs 15 are provided with the guiding abutment surfaces 11 and 12, which beyond the contacting region 17 of the rocker arm 1 against the valve stem end 7 are disposed to the side of the rocker arm. The abutment surfaces 11 and 12 of the legs 15 are expediently disposed against the longitudinal sides 18 and 19 of the rocker arm 1 above the contacting region 17 of the rocker arm. The abutment surfaces 11 and 12 can advantageously slide on the longitudinal sides 18 and 19 to compensate for the relative movements that result due to the differing movement paths of the rocker arm 1 and the valve stem 13.

The width 20 of the legs 15 is approximately equal to the diameter 21 of the valve stem end 7. To reduce the abutment surfaces 11 and 12 for the purpose of reducing the frictional forces, it can be advantageous to provide the legs with a lesser width.

Figure 2:
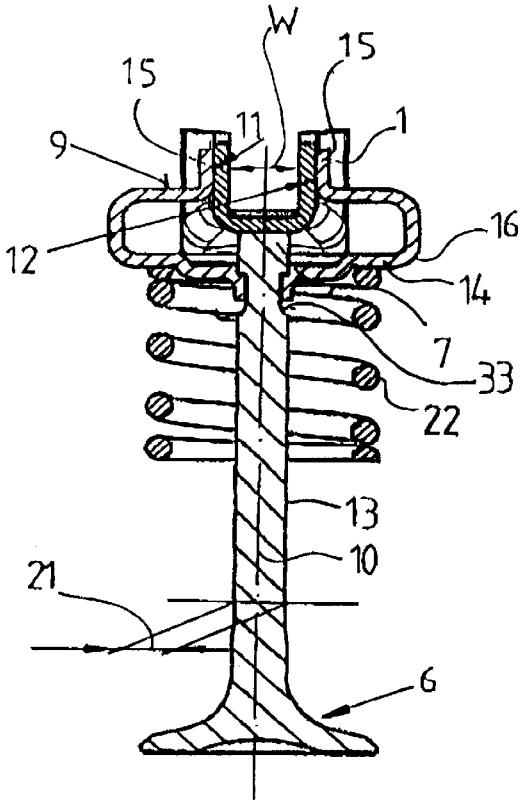
FIG. 2 is a cross-sectional view taken through the rocker arm of FIG. 1 along the line II—II thereof.
Figure 3:
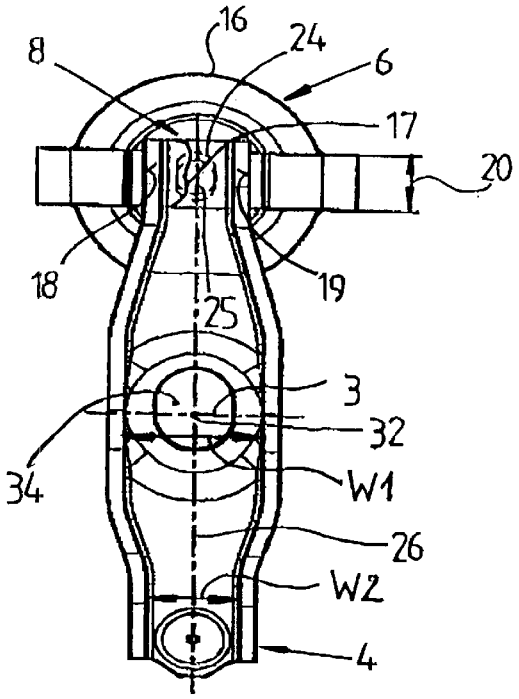
FIG. 3 is a top view of the rocker arm of FIG. 1 taken in the direction of the arrow III.

As shown in FIGS. 2 and 3, in this embodiment, the rocker arm 1 is formed as a sheet metal component having a U-shaped cross-sectional configuration, whereby the width W1 of the section in the region of the swivel joint 2 of the rocker arm 1 is greater than the width W2 at the ends 4 and 8.

FIGS. 1 and 3 clearly show that the swivel joint 2 of the rocker arm 1 is formed in the shape of a spherical segment. For this purpose, a spherical segment 31 is formed into the base 30 of the rocker arm 1 and merges into an oval opening 34 that is disposed centrally relative to the vertical axis 32 of the rocker arm. Extending through the opening 34 is the support pin 40, which to form the swivel joint 2 is provided with the bearing portion in conformity with the spherical segment 31.

In the embodiments of the rocker arm 1 illustrated in FIGS. 1 to 4, the valve stem end 7 extends through a slot 24 (FIG. 3) in the guide element 9 approximately at right angles, whereby the longitudinal axis 25 of the slot 24 is disposed approximately parallel to the longitudinal axis 26 of the rocker arm 1. It is expedient, especially if the guide element 9 is part of the valve spring retainer 14, to hold the guide element 9 in such a way that it is not displaceable in the axial direction of the longitudinal axis 10 of the valve, for example in a notch 33 on the valve stem end 7. The abutment surfaces 11,12 of the legs 15 can be planar or also spherically curved.

Figure 7:
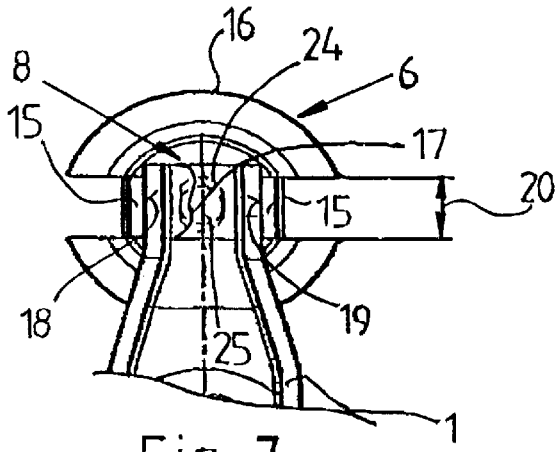
FIG. 7 is a top view of a rocker arm.

As shown in the top view of FIG. 7 of a rocker arm 1, the legs 15 are formed by tabs that are bent up from the rim 16 of the valve spring retainer 14.

The specification incorporates by reference the disclosure of German priority document 100 43230.1 of Sep. 2, 2000.

The present invention is, of course, in no way restricted to the specific disclosure of the specification and drawings, but also encompasses any modifications within the scope of the appended claims.

I claim:

1. A valve drive mechanism comprising:

a rocker arm that by means of a swivel joint is movable about a pivot axis that extends transverse to the rocker arm;

a poppet valve having a valve stem , wherein a second end of said rocker arm acts upon an end of said valve stem;

a control unit that engages a first end of said rocker arm for actuating said poppet valve; and a guide element that is disposed between said valve stem end and said second end of said rocker arm, wherein said guide element is separate from said rocker arm and is a part of a valve spring retainer that is disposed on said valve stem, wherein said guide element is provided with oppositely disposed abutment surfaces that extend transverse to a longitudinal axis of said poppet valve, and wherein said second end of said rocker arm is disposed between said abutment surfaces of said guide element such that the position of said second end of said rocker arm is secured relative to said end of said valve stem.

2. A valve drive mechanism according to claim 1, wherein said guide element is monolithically formed with said valve spring retainer.

3. A valve drive mechanism according to claim 1, wherein said guide element is formed out of said valve spring retainer.

4. A valve drive mechanism according to claim 1, wherein said guide element is a component having a U-shaped cross-sectional configuration, and wherein said guide element is provided with legs that are provided with said abutment surfaces for lateral guidance of said rocker arm.

5. A valve drive mechanism according to claim 4, wherein said legs are strips of material that are bent out of said valve spring retainer.

6. A valve drive mechanism according to claim 4, wherein said legs rest slideably against sides of said rocker arm in a region of said rocker arm that contacts said poppet valve.

7. A valve drive mechanism according to claim 4, wherein a width of said legs is approximately equal to a diameter of said end of said valve stem.

8. A valve drive mechanism according to claim 4, wherein said rocker arm is a sheet metal part having an approximately U-shaped cross-sectional configuration, and wherein said swivel joint is in the shape of a spherical segment.

9. A valve drive mechanism according to claim 4, wherein said guide element is held on said end of said valve stem in such a way that it is not displaceable in the axial direction of the longitudinal axis of said poppet valve.

10. A valve drive mechanism according to claim 1, wherein said guide element is provided with a slot having a longitudinal axis that is disposed approximately parallel to a longitudinal axis of said rocker arm, and wherein said end of the valve stem extends through said slot of said guide element.

11. A valve drive mechanism according to claim 1, wherein said abutment surfaces of said guide element are planar.

12. A valve drive mechanism according to claim 1, wherein said abutment surfaces of said guide element are bulged, especially spherically bulged.

* * * * *